US006749066B2

(12) United States Patent
Bergman

(10) Patent No.: US 6,749,066 B2
(45) Date of Patent: Jun. 15, 2004

(54) LIQUID DETERGENT CONTAINER AND DISPENSING

(75) Inventor: Daniel Bergman, Brooklyn, NY (US)

(73) Assignee: Air Fresh Inc., North Brunswick, NJ (US)

( * ) Notice: Subject to any disclaimer, the term of this patent is extended or adjusted under 35 U.S.C. 154(b) by 0 days.

(21) Appl. No.: 10/222,680

(22) Filed: Aug. 16, 2002

(65) Prior Publication Data

US 2002/0189966 A1 Dec. 19, 2002

Related U.S. Application Data

(63) Continuation-in-part of application No. 09/620,431, filed on Jul. 20, 2000, now Pat. No. 6,439,387.

(51) Int. Cl.[7] ..... B65D 85/84

(52) U.S. Cl. ..... 206/524.4; 53/474; 510/277

(58) Field of Search ..... 206/524.1, 524.4, 206/524.5, 524.6, 525; 220/359.1, 359.4; 53/440, 474, 478; 510/276, 277, 285; 229/123.2, 404

(56) References Cited

U.S. PATENT DOCUMENTS 4,680,916 A * 7/1987 Ginn ..... 53/440
4,942,973 A * 7/1990 Bowie ..... 206/524.6
5,055,215 A * 10/1991 Mains et al. ..... 510/285
5,213,227 A * 5/1993 Koyama et al. ..... 220/359.3
5,316,603 A * 5/1994 Akazawa et al. ..... 53/478
5,627,150 A * 5/1997 Peterson et al. ..... 510/439
6,040,286 A * 3/2000 Huff ..... 206/524.1
6,375,041 B1 * 4/2002 Klima et al. ..... 206/222
6,439,387 B1 * 8/2002 Bergman ..... 206/524.4

* cited by examiner

*Primary Examiner*—Luan K. Bui
(74) *Attorney, Agent, or Firm*—Lackenbach Siegel, LLP

(57) ABSTRACT

A method of packaging liquid detergent or fabric softener for single load use comprising forming a container from a thermoplastic material such as polypropylene, polyethylene, polystyrene and the like, to a size sufficient to contain a 3–4 ounce amount of a liquid bleach or liquid bleaching agent containing detergent in a well thereof. The container comprises an open well with a peripheral lip an open end thereof. A printed foil strip, sized to cover the opening and at least a full circumferential portion of the container lip is heat or adhesive sealed to the plastic after the detergent is disposed therein. The foil and seal are of sufficient strength to retain the 3–4 ounces of liquid bleach or bleaching agent containing detergent even in an obverted position with jostling such as during transport. Because of the nature of the seal, the container is not readily fully reclosable, and the full contents must, as a practical matter, be used once the container is opened, i.e., single use.

14 Claims, 1 Drawing Sheet

LIQUID DETERGENT CONTAINER AND DISPENSING

This application is a continuation-in-part of Ser. No. 09/620,431 filed Jul. 20, 2000, now U.S. Pat. No. 6,439,387.

BACKGROUND OF THE INVENTION

Liquid detergents and fabric softeners are packaged and sold in quantities sufficient for multiple uses or washing loads, i.e., generally for household use where numerous washings take place (volume use of liquid detergents and fabric softeners is roughly equal on a volume basis). The cost of packaging, viz. molded containers and screw caps suitable for retaining such significant amounts of detergent or fabric softener liquids, is a significant portion of the total cost of the detergent. Though solid detergents are available in small tear open packets, there are no similar packages of liquid detergents despite the popularity of such liquid detergents for use in Laundromats and by singles without families where the number of wash loads is usually minimal.

Generally, with deviations in scale, the cost of providing similar, smaller containers with lesser amounts of detergent liquids is normally greater on a proportional basis, especially since liquids are more difficult to package and contain. More economical tear open packets of liquid detergent would be significantly larger than equivalent powder detergent packages (about 3–4 fluid ounces of liquid detergent or fabric softeners are generally required for a single wash load) and would require tougher and leak resistant containment materials, which by this very requirement, are difficult and very inconvenient to tear open especially without accidental spillage. This is particularly a concern, insofar as detergents generally contain caustic bleaching agents or whitening agents, wherein undesired spillage or leakage can cause harm. Accordingly, it has not been considered economically feasible to provide packages with single use amounts of liquid detergents or fabric softeners.

SUMMARY OF THE INVENTION

It is accordingly an object of the present invention to provide a method and container for the economical containment of small amounts of a liquid detergent or fabric softener, sufficient for an average single use, in a non-closable, non-storable, non-reusable economical container which is resistant to accidental spillage but which is readily openable for use, and particularly so wherein caustic bleaches, bleaching agents or whitening agents are to be contained.

It is a further object of the present invention to provide said single use amount of detergent and fabric softener in a container suitable for use in a vending machine for use in commercial Laundromats.

It is yet a further object of the present invention to provide a convenient packaged form for liquid detergent or fabric softener, which requires no measuring or other handling.

Generally the present invention comprises a method and container package for conveniently packaging single use amounts of a liquid detergent or fabric softener in a non-re-closable, non-reusable, non-storable container, comprising the steps of:

a) forming a self-standing leak resistant container with an open well, of a size sufficient to contain enough liquid detergent or fabric softener sufficient for a single average wash load, said container being formed preferably formed from a plastic such as a thermoplastic material (e.g., polypropylene, polyethylene, polystyrene and the like), with said well having an opening, completely peripherally bounded with a peripheral outwardly extending short ledge;

b) filling the container with an amount of liquid detergent or fabric softener sufficient only for about a single average wash load;

c) placing a cover sheet of a material which is securely preferably sealable, preferably heat sealable, on the ledge around the opening of the well and enclosingly across the opening of the well and fully adhering, such as by adhesive and heat sealing, the cover sheet to sealingly enclose the liquid within said container, wherein said cover sheet is congruently sized to the surface having the area dimensions comprising the opening of the well and the ledge therearound, and wherein a portion of the cover sheet is manually accessible for gripping in peeling off the cover sheet from the container when the detergent or fabric softener is to be used, and wherein the seal is of sufficient tensile strength to resist accidental opening of the container, but wherein the seal has a low peel strength for facilitated peeling removal of the cover sheet, preferably without jerking or the leaving of a remaining residue.

A peelable adhesive may be utilized in lieu of a thermoplastic heat seal. Heat actuated adhesives, polymers and resins are within the contemplation of the present invention. It is understood that the adhesive strength is of a similar strength to that of thermoplastic seal, to resist accidental opening of the container prior to use. It is preferred that the adhesive loses a substantial portion of its adhesive properties when the seal is broken in order to discourage re-closure and the likely spilling of any residue sought to be re-sealed.

The cover sheet is preferably a thin metal foil such as of aluminum and is preferably pre-printed with product indicia e.g. manufacturer identification, trademark(s), and usage instructions. The metal is dimensioned to provide sufficient retaining strength for the contained liquids even under jostling shipping and handling conditions. A cover sheet of the same material as the container is to be avoided with a full heat seal since the resultant seal is more of a material weld and may be difficult to separate, especially without leaving a torn residue.

Cost of the individual-use packaging of the present invention which is non-reusable and non-storable is significantly lower than the cost of packaging for liquid detergent or fabric softeners as currently utilized even on a very favorable proportional basis by a factor of at least 5 to 1.

The above and other features and advantages of the present invention will become more evident from the following discussion and drawings in which:

SHORT DESCRIPTION OF THE DRAWINGS

DETAILED DESCRIPTION OF THE INVENTION

The containers made in accordance with the present invention are formed with frusto-conical sloped walls whereby the cups can be nested within each other for facilitated storage and processing. The peripheral ledges are preferably configured with a flat upper surface for heat sealing with the cover sheet and with a channeled lower surface to enhance structural rigidity. A peripheral indent in the wall of the container permits offset nesting of the containers for easy removal separation from each other. The peripheral ledges are minimized in lateral extent to concomitantly minimize peeling effort but are sufficiently wide enough to effect a heat seal of the requisite strength or the application of sufficient adhesive for adherence of sufficient strength. A ⅛ inch extension is an effective width for a container with approximate dimensions of 1.8" height and 2.75" diameter opening. Because of the frusto-conical structure, the base of the cup has a smaller diameter of about 2.4" to provide a well sufficient to contain the requisite maximum of four ounces of liquid. Though the containers may be larger and capable of containing more liquid, it is preferred that the volume of the container not be more than 25% above the volume actually required by the liquid.

The containers are preferably made of polystyrene with an indent base to increase structural strength thereof.

An extending tab section of the cover sheet is folded down when not used and lifted as a starting lever for removal of the cover sheet from the container when the detergent is to be used. After removal of the cover sheet, the liquid detergent or fabric softener is poured into the wash load, at an appropriate point of the wash cycle without measuring or manipulation and the container and cover are discarded. No portion of the detergent can be readily stored since the contained amount is pre-measured for the load and the cover sheet cannot be re-adhered (absent a second heat sealing) and is too small to otherwise be wrapped around the container opening and a liquid in an open cup is not readily stored without spillage.

A normal wash load amount for a non-concentrated detergent or fabric softener is about 3–4 ounces with concentrated liquids being proportioned therefrom. The container is thus provided with a well capable of containing at least the maximum of 4 ounces.

DETAILED DESCRIPTION OF THE DRAWINGS AND THE PREFERRED EMBODIMENT

Figure 1:
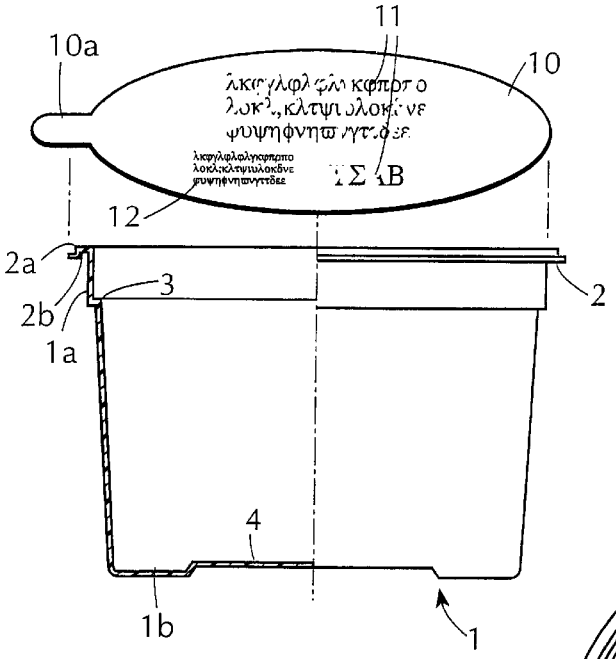
FIG. 1 is a partial sectioned side view of a container made in accordance with the present invention with a cover sheet being placed thereon.
Figure 2:
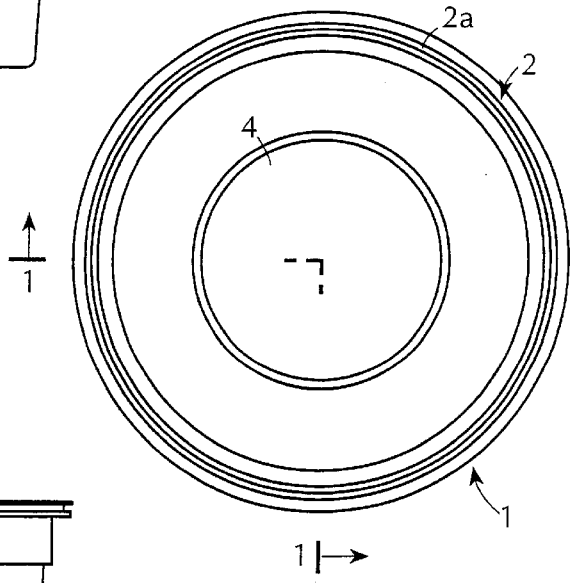
FIG. 2 is a top view of the open container of FIG. 1.
Figure 3:
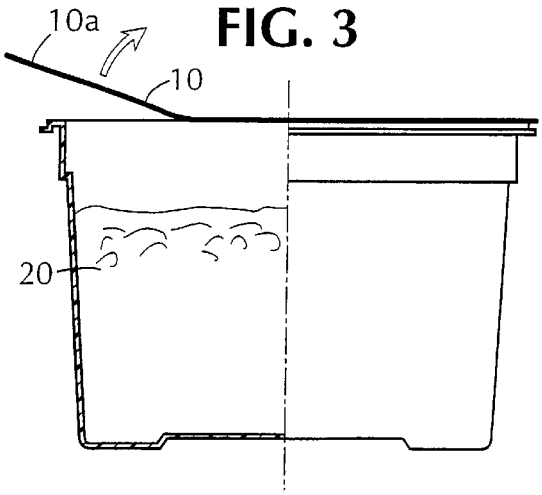
FIG. 3 is the container of FIG. 1, having been sealed by the cover sheet and filled with liquid detergent, as it is being opened.

With reference to the drawings, in FIG. 1 a thermoformed container cup 1 having a capacity of about 4.5 to 5 fluid ounces of liquid detergent or fabric softener. The container 1 is of frusto-conical shape with a wider opening 1*a* than the closed base 1*b*, whereby multiple cups may be readily nested. Ledge 2 peripherally completely surrounds the opening (as more clearly seen in FIG. 2) with flat upper surface 2*a* for heat or adhesive sealing with foil cover sheet 10. Lower ledge surface 2*b* is channel shaped for rigidity and structural strength to withstand peeling forces when the cover sheet 10 is removed therefrom (FIG. 3). Indent 3 is adapted to rest on the succeeding ledge 2 of a second container into which container 1 is nested, in a stack of containers used for processing. The base 1*b* of the container comprises a circular recess 4 to impart further rigidity to the base of the container and to enhance standing stability.

As seen in FIG. 3, cover sheet 10 is printed with indicia of manufacturer and trademarks 11 and instructions 12 and container 1 is substantially filled with liquid detergent 20, pre-measured for a single wash load. Cover sheet 10 is sized to fit on ledge 2 with tab extension 10 used to grasp the cover sheet for peeling removal, as shown. Cover sheet 10 is not redeployable and is either enrtirely or partially removed and the detergent 20 is poured into the wash load, as required, and the cover sheet 10 and container are discarded. With the minimal size of the containers and the standing stability thereof, they may be individually sold in vending machines at Laundromats for on site use or they may be used as single use conveniences and sold in packs such as six-packs with an appropriate carrier.

Useful adhesive seals within the contemplation of the present invention includes, by way of example, the heat sealable resin blends disclosed in U.S. Pat. No. 4,189,519, granted Feb. 19, 1980 to Ticknor; the polymers and combination of polymeric mixtures disclosed in U.S. Pat. No. 4,810,541, granted May 7, 1989 to Newman et al; and the hot melt block copolymers disclosed in U.S. Pat. No. 5,372,870 to Diehl et al.

It is understood that the above description and drawings showing a particular embodiment are merely illustrative of the present invention and that changes may be made in the structure, components and configuration of the container and cover without departing from the scope of the present invention, as defined in the following claims.

What is claimed is:

1. A method for packaging single use amounts of any of a liquid detergent or liquid fabric softener in a non-closable, non-reusable, non-storable container, comprising the steps of:

a) forming a self-standing container with an open well, of a size sufficient to contain enough liquid detergent or fabric softener sufficient for a single average wash load, with said well having an opening, completely peripherally bounded with a peripheral outwardly extending short ledge;

b) filling the container with an amount of the liquid detergent or fabric softener, sufficient only for about a single average wash load;

c) placing a cover sheet of a sealable material on the ledge around the opening of the well and enclosingly across the opening of the well and fully sealing the cover sheet to sealingly enclose the liquid within said container, wherein said cover sheet is congruently sized to the surface having the area dimension comprising the opening of the well and the ledge therearound, and wherein a portion of the cover sheet is manually accessible for gripping in peeling off the cover sheet from the container when the detergent or fabric softener is to be used;

wherein the seal is of sufficient tensile strength to resist accidental opening of the container but wherein the seal has a low peel strength for facilitated peeling removal of the cover sheet without jerking or the leaving of a remaining residue.

2. The method of claim 1, wherein said cover sheet comprises a printed metal foil sheet with product indicia thereon.

3. The method of claim 1, wherein said amount of liquid detergent or fabric softener is a single wash load quantity of up to about 4 ounces, and said container is adapted for the containment thereof.

4. The method of claim 1, wherein said container comprises a frusto-conical configuration.

5. The method of claim 1, said sealing comprises polymeric adhesive sealing.

6. The method of claim 1, wherein said ledge is formed with a flat upper surface adapted for sealing to said cover sheet, and a channeled lower surface to impart rigidity to said ledge.

7. A container, with one of liquid detergent and liquid fabric softener sealingly contained therein, for single use with an average wash load, said container being self-standing and, formed from a leak resistant self supporting material and having an open well of a size sufficient to contain enough liquid detergent or fabric softener sufficient for a single average wash load, with said well having an opening, completely peripherally bounded with a peripheral outwardly extending short ledge; said container further comprising a cover sheet on the ledge around the opening of the well and enclosingly across the opening of the well and fully sealed to said ledge to sealingly enclose the liquid within said container, wherein said cover sheet is congruently sized to the surface having the area dimensions comprising the opening of the well and the ledge therearound, and wherein a portion of the cover sheet is manually accessible for gripping in peeling off the cover sheet from the container when the detergent or fabric softener is to be used;

wherein the seal is of sufficient tensile strength to resist accidental opening of the container but wherein the seal has a low peel strength for facilitated peeling removal of the cover sheet without jerking or the leaving of a remaining residue.

8. The container of claim 7, further comprising an adhesive seal disposed between the cover sheet and the ledge.

9. The container of claim 8, said adhesive seal comprising a peelable heat seal.

10. The container of claim 7, said detergent comprising a bleaching agent.

11. A container, with a liquid comprising a bleach or bleaching agent sealingly contained therein, for single use with an average wash load, said container being self-standing and, formed from a leak resistant self supporting material and having an open well of a size sufficient to contain enough liquid detergent or fabric softener sufficient for a single average wash load, with said well having an opening, completely peripherally bounded with a peripheral outwardly extending short ledge; said container further comprising a cover sheet on the ledge around the opening of the well and enclosingly across the opening of the well and fully sealed to said ledge to sealingly enclose the liquid within said container, wherein said cover sheet is congruently sized to the surface having the area dimensions comprising the opening of the well and the ledge therearound, and wherein a portion of the cover sheet is manually accessible for gripping in peeling off the cover sheet from the container when the detergent or fabric softener is to be used;

wherein the seal is of sufficient tensile strength to resist accidental opening of the container but wherein the seal has a low peel strength for facilitated peeling removal of the cover sheet without jerking or the leaving of a remaining residue.

12. The container of claim 11, further comprising an adhesive seal disposed between the cover sheet and the ledge.

13. The container of claim 12, said adhesive seal comprising a peelable heat seal.

14. The container of claim 13, said adhesive seal comprising a olymeric adhesive seal.

* * * * *